US007232295B2

(12) United States Patent
Kriehn et al.

(10) Patent No.: US 7,232,295 B2
(45) Date of Patent: Jun. 19, 2007

(54) TEMPERING METHOD FOR A SCREW-TYPE VACUUM PUMP

(75) Inventors: Hartmut Kriehn, Köln (DE); Klaus Rofall, Rösrath (DE); Manfred Behling, Köln (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 252 days.

(21) Appl. No.: 10/495,834

(22) PCT Filed: Oct. 30, 2002

(86) PCT No.: PCT/EP02/12087

§ 371 (c)(1),
(2), (4) Date: May 14, 2004

(87) PCT Pub. No.: WO03/042542

PCT Pub. Date: May 22, 2003

(65) Prior Publication Data

US 2005/0019169 A1 Jan. 27, 2005

(30) Foreign Application Priority Data

Nov. 15, 2001 (DE) ..... 101 56 179

(51) Int. Cl.
*F01C 21/00* (2006.01)
*F03C 2/00* (2006.01)
*F04C 2/00* (2006.01)

(52) U.S. Cl. ..... 418/2; 418/1; 418/84; 418/87; 418/201.1; 417/368

(58) Field of Classification Search ..... 418/1, 418/85, 88, 97, 101, 201.1, 2, 83, 84, 87; 417/368

See application file for complete search history.

(56) References Cited

U.S. PATENT DOCUMENTS

| | | | | |
|---|---|---|---|---|
| 4,302,160 | A | 11/1981 | Hofmann, Jr. | |
| 4,895,220 | A * | 1/1990 | Abraham et al. | 184/6.4 |
| 4,983,106 | A | 1/1991 | Wright et al. | |
| 5,328,344 | A | 7/1994 | Satp | |
| 6,126,425 | A * | 10/2000 | Fukui | 418/201.1 |
| 6,315,535 | B1 * | 11/2001 | Hoshi et al. | 418/2 |
| 6,544,020 | B1 | 4/2003 | Bahnen et al. | |
| 7,056,108 | B2 * | 6/2006 | Behling et al. | 418/85 |
| 2003/0147764 | A1 | 8/2003 | Kreihn | |
| 2004/0022646 | A1 | 2/2004 | Garczorz | |

FOREIGN PATENT DOCUMENTS

| | | |
|---|---|---|
| BE | 1008367 | 4/1996 |
| DE | 2217022 | 10/1973 |
| DE | 4220015 A1 | 12/1993 |
| DE | 4320537 | 12/1993 |
| DE | 29505608 U1 | 7/1996 |
| DE | 19745616 | 4/1999 |

(Continued)

*Primary Examiner*—Theresa Trieu
(74) *Attorney, Agent, or Firm*—Fay Sharpe LLP

(57) ABSTRACT

A screw-type vacuum pump (1) is tempered such that characteristics of the pump are not substantially altered when the pump is subjected to thermal stress. In order to achieve said aim, cooling is adjusted according to an operating state of the screw-type vacuum pump (1), preferably to maintain a substantially constant pump gap (4).

25 Claims, 2 Drawing Sheets

FOREIGN PATENT DOCUMENTS

| | | | | | |
|---|---|---|---|---|---|
| DE | 19749572 | | | 5/1999 | |
| DE | 19800825 | | | 7/1999 | |
| DE | 19817351 | | | 10/1999 | |
| DE | 19820523 | | | 11/1999 | |
| DE | 19849098 | | | 4/2000 | |
| DE | 200133338 | U | | 12/2000 | |
| DE | 19945871 | | | 3/2001 | |
| DE | 19963171 | | | 6/2001 | |
| DE | 19963172 | | | 6/2001 | |
| DE | 10019066 | | | 10/2001 | |
| JP | 53012507 | A | * | 2/1978 | ..... 418/85 |
| JP | 59115492 | | | 7/1984 | |
| JP | 01300073 | | | 12/1989 | |
| JP | 02149795 | A | * | 6/1990 | ..... 418/201.1 |
| JP | 03175166 | A | * | 7/1991 | ..... 417/368 |
| JP | 04086394 | A | * | 3/1992 | ..... 418/85 |
| JP | 6330875 | | | 11/1994 | |

* cited by examiner

TEMPERING METHOD FOR A SCREW-TYPE VACUUM PUMP

BACKGROUND OF THE INVENTION

The invention relates to a method for tempering a screw-type vacuum pump. Moreover, the invention relates to a screw-type vacuum pump suited for implementing said method.

From DE-A-198 20 523 a screw-type vacuum pump of the here affected kind is known. The multitude of heat problems has been disclosed. Cooling of the rotors revolving in a pump chamber involves special difficulties when the threads of the rotors exhibit a pitch which decreases from the intake side to the delivery side, frequently even also in combination with an increase in the width of the thread ridges. Rotors of this kind are subjected during operation to severe thermal stresses, in particular in the area of their delivery side, since the compression of the pumped gases produces a not insignificant amount of heat. Since the quality of a screw-type vacuum pump depends significantly on the gap between the rotors and the pump chamber housing, the manufacturers strive to keep this gap very small. However, opposed to this aim is the thermal expansion of the thermally highly stressed areas, rotors and housing. The pump chamber housing does not, or only slightly, take part in the thermal expansion of the rotors. A sufficiently large gap must be present. It was previously only in this manner possible to prevent the rotors from making contact with the housing with the attendant risk of standstill seizing. The problem detailed grows to be particularly grave when the rotors and the housing consist of different materials. In the instance of the coefficient of expansion of the housing being smaller than the expansion of coefficient of the rotor material (for example, housing made of cast iron, rotors of aluminium) there exists the risk of the rotors running against the housing. If the reverse expansion conditions exist, the pump's gap can increase such that the performance of the pump decreases.

It is the task of the present invention to design and be able to operate a screw-type vacuum pump of the here affected kind such that during thermal stresses its properties will not change substantially.

SUMMARY OF THE INVENTION

Through the present invention it is possible to have an influence on the effect of the cooling, respectively tempering, with the aim of permitting a temperature increase in the pump chamber housing which does not exceed inadmissible limits. During an increased thermal stress on the pump, the only slightly cooled pump chamber housing expands jointly with its rotors. The risk of making contact does no longer exist. The cooling system is controlled expediently such that the size of the gaps in the pump chamber housing remains substantially unchanged during the different operating conditions.

For example, the outside temperature of the pump chamber housing may be employed as the controlled variable.

If the screw-type vacuum pump is air cooled, then the cooling air flow may be controlled depending on the operating status of the pump, for example by controlling the rotational speed of a fan producing the cooling air flow. This requires that the fan be equipped with a drive being independent of the drive motor of the pump. If the fan is linked to the drive of the pump, control of the cooling air flow can be implemented with the aid of adjustable screens, throttles or alike. If the pump is cooled by liquids, control can be effected by adjusting the quantity (flow rate) or the temperature of the cooling liquid.

If the pump is air cooled from the outside and if its rotors are equipped with a liquid cooling system, it is expedient to arrange a heat exchanger in the cooling air flow so as to dissipate the heat dissipated by the liquid (oil, for example). When said heat exchanger is arranged, with respect to the direction of the flowing cooling air, upstream of the pump chamber housing, well-aimed tempering of the pump chamber housing is possible. Again, the outside temperature of the pump chamber housing may serve as the controlled variable; also the temperature of the cooling liquid may be employed as the controlled variable. Arrangements of this kind allow, above all, cooling of the pump to be controlled such that the gap between the rotors and the housing is maintained during operation of said pump at a substantially constant width.

Moreover, it is expedient when the pump is equipped with an inner rotor cooling system (liquid) and a housing cooling system (from the outside with liquid), and where both cooling systems are controlled matched to each other such that during all operating modes of the pump a substantially constant gap is maintained. The desired control with the aim of a constant gap is effected such that the quantities of liquid supplied to the cooling systems, for example with the aid of a heat exchanger, are controlled depending on cooling demand.

In order to be able to implement the desired control, the utilization of sensors is required. These may be temperature sensors, the signals of which are supplied to a control center. The control center in turn regulates the intensity of the cooling, preferably in such a manner that the pump gap is maintained at a substantially constant width. Instead of one or several temperature sensors, also a distance sensor may be employed which supplies direct information on the size of the gap.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
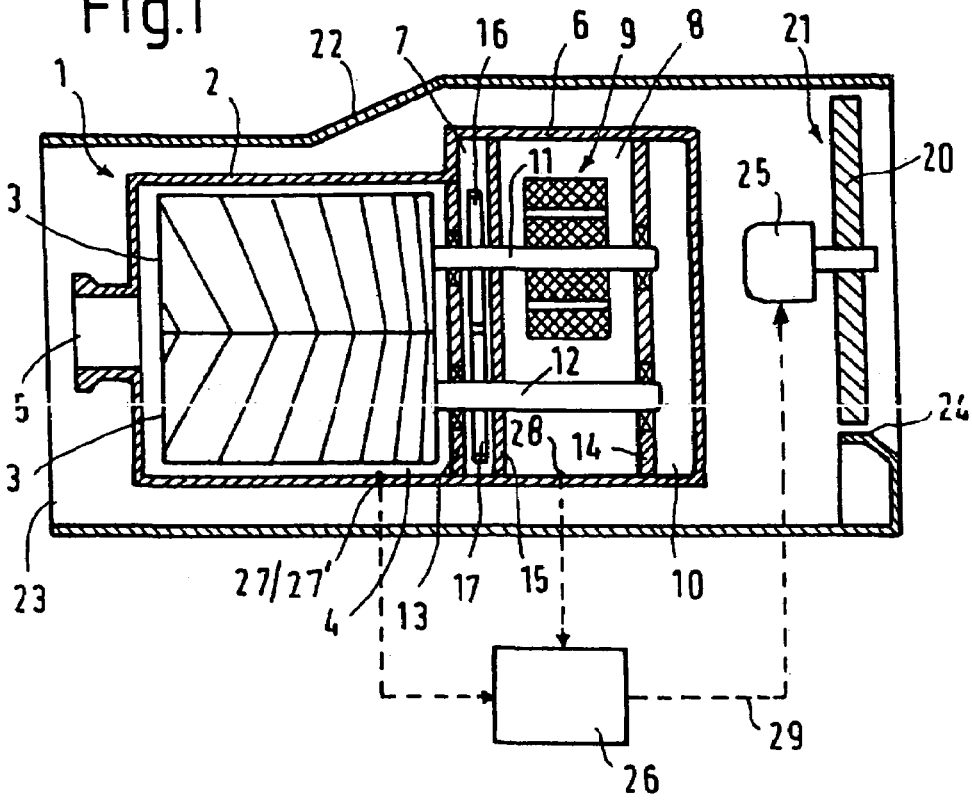
FIG. 1 is a longitudinal section of an air cooled screw-type vacuum pump and cooling system.

In the Figure, a screw-type vacuum pump to be cooled is designated as 1, its pump chamber housing with 2, its rotors with 3, the gap on the delivery side between the rotors 3 and pump chamber housing 2 with 4, and its inlet with 5. The gear/motor chamber housing adjacent the pump chamber housing 2 containing the rotors 3 is designated as 6. It is only schematically outlined that the rotors 3 are equipped with threads, with their pitch and ridge width decreasing from the intake side to the delivery side. An outlet located on the delivery side is not depicted. Located in housing 6 is the gear chamber 7, the motor chamber 8 with the drive motor 9 and a further chamber 10, being the bearing chamber (FIG. 1) or part of a cooling liquid circuit for the rotors 3 (FIGS. 2 and 3).

The rotors 3 are equipped with shafts 11, 12 which penetrate the gear chamber 7 and the motor chamber 8. By means of bearings in the separating walls between the pump chamber and the gear chamber 7 (separating wall 14) as well as motor chamber 8 and bearing respectively a cooling liquid chamber 10 (separating wall 14), the rotors 3 are suspended in a cantilevered manner. The separating wall between gear chamber 7 and motor chamber 8 is designated as 15. Located in the gear chamber 7 is the pair of toothed wheels 16, 17 effecting the synchronous rotation of the rotors 3. The rotor shaft 11 forms simultaneously the drive shaft of the motor 9. The motor 9 may exhibit a drive shaft different from the shafts 11, 12. In the instance of such a solution, the drive shaft of said motor terminates in gear chamber 7 and is there equipped with a toothed wheel, which engages with one of the synchronising toothed wheels 16, 17 (or a further toothed wheel, not depicted, of the shaft 12).

Figure 2:
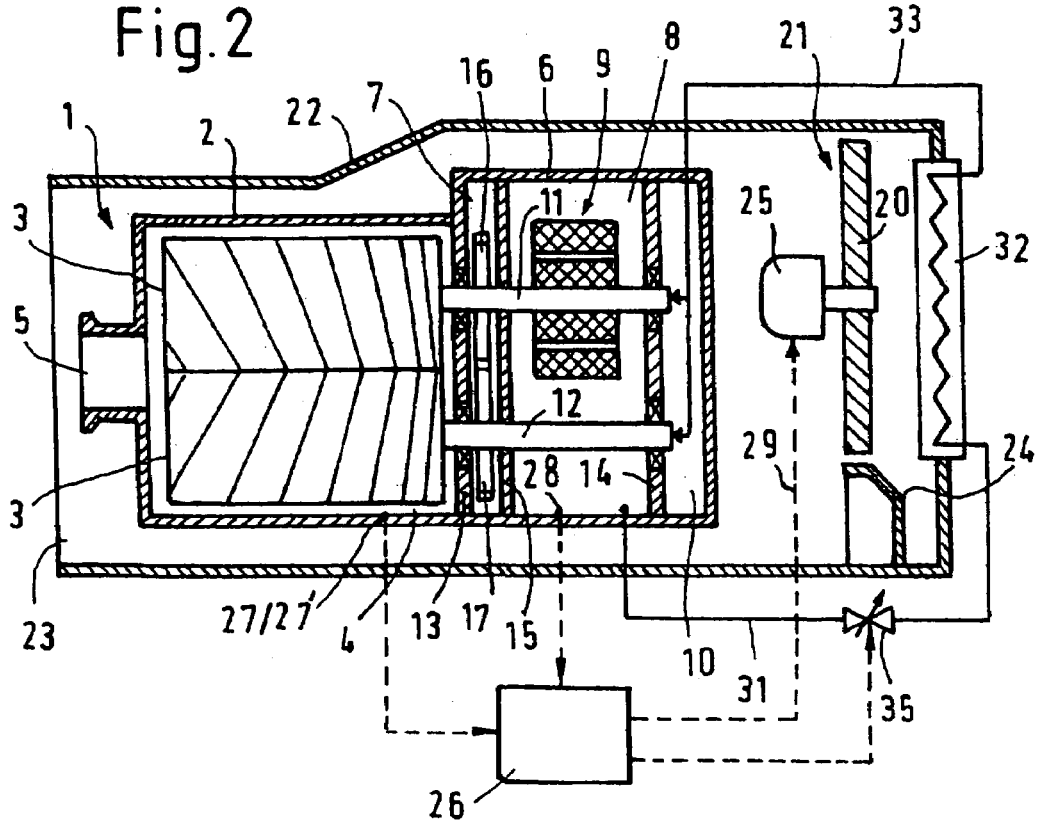
FIGS. 2 and 3 each illustrate an air and liquid cooled screw-type vacuum pump.
Figure 3:
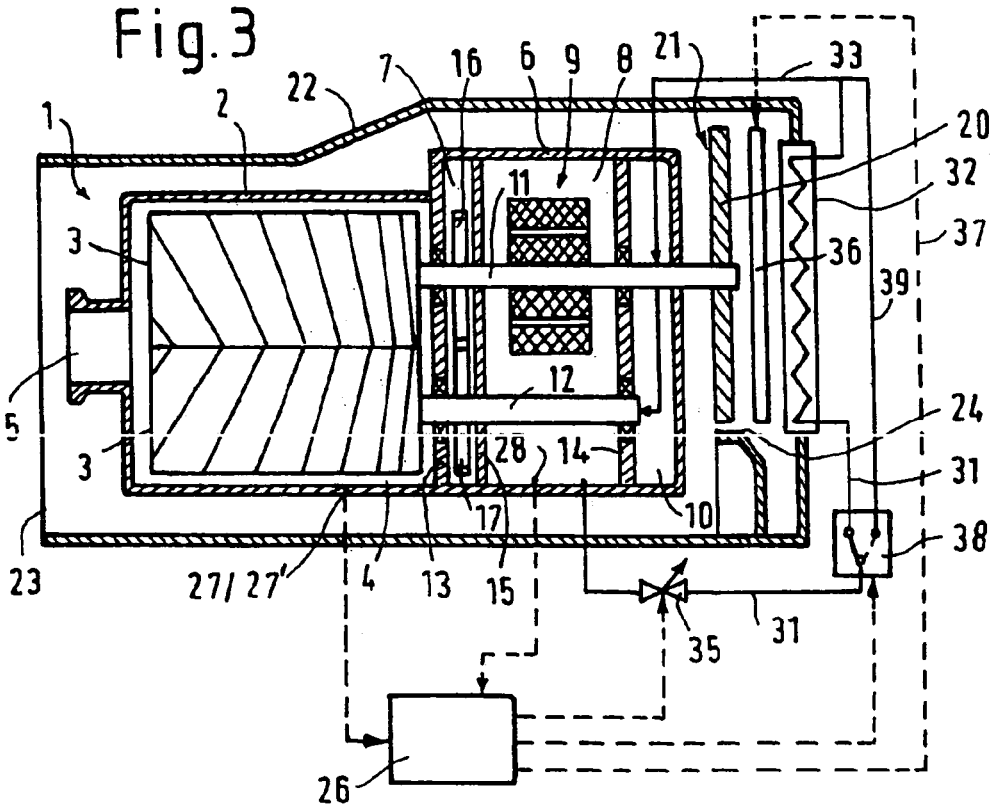

In the embodiments according to the FIGS. 1 to 3, cooling of the housings 2 and 6 of the pump 1 is effected with aid of an air flow produced by the wheel or impeller 20 of a fan 21. A housing 22 encompassing the pump 1 serves the purpose of guiding the air movement produced by the blade wheel 20, said housing being open (apertures 23, 24) in the area of both its sides. Fan 21 is arranged such that the aperture 24 on the fan/motor side of the housing 22 forms the air inlet aperture.

In the embodiments according to the FIGS. 1 and 2, the fan 21 has a drive motor 25 independent of the drive motor 9 of the pump 1. This solution is advantageous for screw-type vacuum pumps. The motor 9 of which is depicted as a canned motor, is thereby encapsulated.

Figure 4:
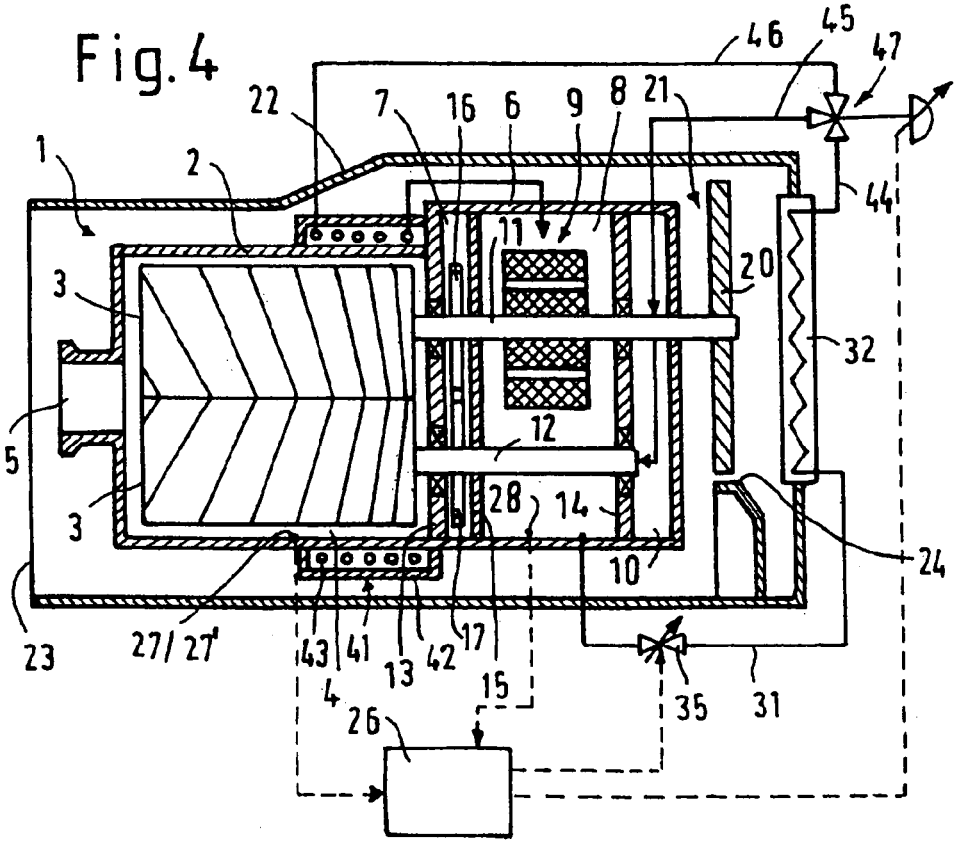
FIG. 4 illustrates a screw-type vacuum pump equipped with two liquid cooling systems.

In the embodiments according to the FIGS. 3 and 4, the shaft 11 penetrates the chamber 10, is run out of the housing 6 of the pump 1, and carries at its unoccupied end the wheel 20 of the ventilator or fan 21.

In all Figures, a control facility or module is in each instance schematically represented by way of block 26. It is linked through lines depicted by way of dashed lines to sensors supplying the signals of desired manipulated variables. As examples, two alternatively or simultaneously employable temperature sensors 27 and 28 are depicted. Sensor 27 supplies signals corresponding to the temperature of the housing 2. Said sensor is preferably affixed at the housing 2 in the area of the delivery side of the rotors 3. Sensor 28 is located in the motor chamber and supplies signals which correspond to the temperature of the cooling liquid, preferably oil temperature. Through further lines the control facility is linked in each instance to facilities aiding controlled cooling of the pump 1 in the desired manner.

In the embodiment according to FIG. 1, the air flow produced by the fan 21 is controlled. For this purpose the control facility 26 is connected through the line 29 to the drive motor 25. Corresponding to the signals supplied by one or both sensors 27 or 28, control of the rotational speed of the blade wheel 20 is effected. Since the signals supplied by the sensor 27 provide information on the housing temperature and the signals supplied by the sensor 28 provide information on the rotor temperature, the utilization of both sensors can be employed to perform a differential control with respect to the gap 4.

In the instance of an alternative solution, only one sensor 27' may be provided instead of the two temperature sensors 27, 28, said sensor 27' being located, for example, at the location of the temperature sensor 27, i.e. in the area of the delivery side of the pump chamber 2. The sensor 27' is a distance sensor which supplies direct information as to the magnitude of the pump gap 4. Sensors of this kind are basically known. Changes in capacitance or—preferably—changes in an eddy current which occur depending on the size of the gap are employed for producing the sensor signals.

Alone depending on one sensor 27' of this kind, tempering of the pump 1 can be controlled. If, for example, during operation of the pump the size of the gap decreases in that the rotors 3 expand, cooling of the housing 2 is reduced by reducing the quantity of cooling air by a reduction in speed of the ventilator 20. Thus the housing expands so that the decrease in gap size can be compensated. If during operation of the pump 1 the gap size increases, this increase may be compensated by increasing the cooling effect (shrinking of housing 2).

The embodiment according to FIG. 2 differs from the embodiment according to FIG. 1 in that the pump 1 is equipped with a liquid cooling system for the rotors. The cooling liquid circuit for cooling the rotors 3 is only outlined schematically. In patent/applications U.S. Pat. No. 6,544.020, DE 199 63 171.9, US 2003/147764, cooling systems of this kind are described in detail. The shafts 11 and 12 serve the purpose of transporting the coolant (oil, for example) to and from the rotors 3. In the example of an embodiment presented, the coolant exiting the rotors 3 collects in the motor chamber 8. From there it is supplied through the line 31 to a heat exchanger 32. The heat exchanger 32 may be air or water cooled. Especially expedient—as depicted—is an arrangement where the air flow produced by the fan 21 dissipates the heat dissipated by the cooling liquid in the rotors 3. The liquid exiting the heat exchanger 32 is supplied through the line 33 into the chamber 10. In a manner not depicted in detail said cooling liquid passes from there through bores located in the shafts 11, 12 to the rotors 3, flows there through cooling ducts and passes through the shafts 11, 12 back into the motor chamber 8.

In order to control the liquid cooling system, two alternatives for the actuating variable (already described sensors 27, 28) and two alternatives for controlled cooling of the cooling liquid in the heat exchanger 32 are depicted in FIG. 2. Either, as depicted in FIG. 1, the rotational speed of a blade wheel 20 is controlled depending on one of the manipulated variables. In the instance of the other alternative, a control valve 35 in line 31 defines the quantity of cooling liquid flowing through the heat exchanger per unit of time.

In the instance of the solution according to FIG. 2, the pump 1 may be tempered in addition by the air flow of the fan 21. In this instance, it is expedient to arrange the heat exchanger 32 and fan 21 in the area of the aperture 24. The advantage of this arrangement is such that the air flow cooling the pump chamber housing 2 of the pump 1 is pre-warmed. In this manner it is achieved that thermal expansions of the pump chamber housing 2 are allowed to such an extent that the rotors 3 which during operation of the pump 1 attain relatively high temperatures, will not make contact with the housing 2. Preferably, the housing 2 and the rotors 3 consist of aluminium for the purpose of improving heat conductance. Moreover, the housing 2 may exhibit fins for improving thermal contact and heat transfer.

Irrespectively whether the air flow produced by fan 21 cools only the heat exchanger 32 or the heat exchanger 32 and the housing 2, 6 of the pump, it is expedient to locate the heat exchanger 32 upstream of the blade wheel thereby providing a means of touch protection, i.e., a guard which prevents operator contact with the fan blade.

In the instance of the solution according to FIG. 3, the blade wheel 20 is coupled to the motor shaft 11. Since screw-type vacuum pumps are commonly operated at constant rotational speeds, there no longer exists the possibility of controlling the air flow with the aid of the fan 21. For the purpose of controlling the air flow, a controllable aperture 36 (iris aperture, for example), throttle or alike is provided in the instance of the embodiment according to FIG. 3. Said aperture is located between the blade wheel 20 and the heat exchanger 32, is only depicted schematically with reference number 36. Through the line 37 the aperture 36 is connected to the control facility 26. Control of the magnitude of the cooling air flow and/or cooling of the liquid is effected corresponding to the control arrangement detailed for FIG. 2 by controlling the flow cross-section of the air flow, preferably with respect to a constant gap size.

Additionally, the cooling liquid circuit in the instance of the solution according to FIG. 3 is equipped with a thermostatic valve 38. It is located in the line 31 and is preferably also controlled by the control module or facility 26. During the phase of operational start-up of pump 1 in which the cooling liquid has not yet attained its operating temperature, said thermostatic valve has the task of blocking the line 31 and supplying the cooling liquid through the bypass line 39 directly into line 33 bypassing the heat exchanger.

When the temperature of the cooling liquid has attained its operating temperature, line 39 is blocked and line 31 is opened (drawn position of the valve 38). The bypass solution reduces the time needed for the start-up phase.

In the example of the embodiment according to FIG. 4, the screw-type vacuum pump is equipped with the already described inside cooling system for the rotors as well as with a housing cooling system 41 operated with a liquid. Said housing cooling system comprises a cooling jacket 42 (filled with liquid, for example) located at the outlet area of the rotor housing 2. A cooling coil 43 through which the actual coolant flows is located in the cooling jacket 42. Alternatively the cooling liquid may flow also through the cooling jacket 42 itself.

In the presented example of an embodiment, the outlet of the housing cooling system is linked to the motor chamber 8 into which also the cooling liquid exiting the internal rotor cooling system flows. Through the line 31 the cooling liquid passes into the heat exchanger 32. Connected downstream thereto is the line 44 with a 3/2 way valve 47 which selectively splits the quantities of the cooling liquid supplied between the lines 45 and 46.

Line 45 is linked to the inlet of the internal rotor cooling system, line 46 is linked to the inlet of the outer housing cooling system 41. The valve 47 is a control valve controlled by the controller 26.

In the example of the embodiment according to FIG. 4 the ventilator 20 and the heat exchanger 32 are located, as in the instance of the embodiments according to FIGS. 2 and 3, in the area of the aperture 24 of the housing 22. Since cooling by an air flow is no longer an absolute necessity (it only cools the motor and gear housing 6), the heat exchanger 32 and its cooling system (air or liquid) may also be arranged at a different location and independently of the drive motor 9. For both cooling circuits also separate heat exchangers may be provided. Finally, the housing 22 need not be present.

In the embodiment according to FIG. 4 tempering of the pump 1 may—as also in the instance of all other examples of embodiments—be effected such that its pumping gap 4 is maintained substantially constant. The sensors 27 and 28 supply signals which are related to the temperatures of the housing 2 on the one hand and the rotors 3 on the other hand. Depending on these signals, the valve 45 splits of the cooling liquid shares to both cooling systems in ratios set by the control module 26.

In all, the features according to the present invention permit a further increase in performance density of a screw-type pump. The pump may be designed to be smaller and may be operated at higher surface temperatures. The outer housing 22 serving the purpose of guiding the air also serves the purpose of providing a means of touch protection. It has been found expedient to adjust the cooling such that in the instance of two cooling systems (inner rotor cooling system and outer housing cooling system) approximately half of the heat produced by the pump is dissipated by each of the two cooling systems.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A method of tempering a screw type vacuum pump which includes:

a pump housing including a pump chamber housing and a gear/motor housing having a gear chamber and a motor chamber, screw rotors mounted in said pump chamber housing and suspended in a cantilevered manner;

said screw rotors being equipped with shafts penetrating said gear chamber and said motor chamber, cooling means for cooling the pump;

controlling means for controlling the cooling means in dependence of an operational status of the pump;

sensing means including a first and a second temperature sensor, the first temperature sensor supplying signals corresponding to the temperature of said pump chamber housing, the second temperature sensor supplying signals corresponding to the temperature of the rotors, said sensors being connected to the controlling means and said controlling means being connected to the cooling means, the method comprising:

with the control means controlling the cooling means in dependence of the sensed temperatures of the pump housing and the rotors in such a manner that a width of a gap between the rotors and the pump housing remains essentially constant.

2. The method according to claim 1, wherein the cooling means includes a fan producing an air flow for cooling the pump from outside, and wherein the method further includes:

controlling a rotational speed of the blades of the fan in accordance with the sensed temperatures.

3. The method according to claim 1, wherein the cooling means includes a fan producing an air flow for cooling the pump from outside, and wherein the method further includes:

controlling a cross-section of an air flow with the control means.

4. The method according to claim 1, wherein the cooling means includes a liquid rotor cooling system for cooling the rotors with a liquid cooling agent including a heat exchanger, and wherein the method further includes:

controlling a temperature of the liquid cooling agent in accordance with the sensed temperature.

5. The method according to claim 4, wherein controlling the temperature of the liquid cooling agent of the liquid cooling system includes:

impelling a controlled air flow through said heat exchanger of the liquid cooling system.

6. The method according to claim 4, further including:

controlling a quantity of the cooling agent flowing through said heat exchanger.

7. The method according to claim 1, further including:

cooling the pump chamber housing of the vacuum pump from the outside; and, cooling the rotors disposed in the pump chamber housing from the inside.

8. The method according to claim 7, further including:

cooling an exterior of the pump chamber housing of the vacuum pump with impelled air;

cooling the rotors disposed in the pump chamber housing with a cooling liquid;

flowing the cooling liquid through a heat exchanger; and cooling the heat exchanger with the impelled air that cools the housing exterior.

9. The method according to claim 8, further including:

cooling the housing of the vacuum pump with a liquid housing cooling system.

10. The method according to claim 9, further including:

supplying the cooling liquid exiting the heat exchanger to a rotor liquid cooling system and a housing liquid cooling system; and selectively controlling portions of the cooling liquid supplied to the rotor and housing cooling systems.

11. The method according to claim 10, further including:

flowing the cooling liquid supplied to the housing cooling system through a separate heat exchanger.

12. The method according to claim 7, wherein a quantity of heat dissipated from a rotor cooling system and a quantity of heat dissipated from a housing cooling system are approximately equal.

13. A screw type vacuum pump comprising:

a pump housing including a pump chamber housing and a gear/motor housing;

screw rotors mounted in said pump chamber housing and suspended in a cantilevered manner, said screw rotors being equipped with shafts penetrating said gear/motor housing;

a cooling system to cool the pump;

a first and a second temperature sensor, the first temperature sensor supplying signals corresponding to a temperature of the pump chamber housing, the second temperature sensor supplying signals corresponding to the temperature of the rotors;

a controller connected to the first and second sensors and the cooling system and controlling the cooling system in dependence of the sensed temperatures of the pump housing and the rotors in such a manner, that a width of a gap between the rotors and the pump housing remains essentially constant.

14. The vacuum pump according to claim 13, wherein the cooling system includes:

a fan which produces an air flow for cooling the pump housing from outside, a rotational speed of blades of the fan being controlled by the controller.

15. The vacuum pump according to claim 13, wherein the cooling system includes:

a fan which produces an air flow for cooling the pump from outside, a cross-section of the air flow being controlled by the controller.

16. The vacuum pump according to claim 13, wherein the cooling system includes:

a liquid rotor cooling system for cooling the rotors; and, a heat exchanger which controls a temperature of a liquid cooling agent.

17. The vacuum pump according to claim 16, wherein the cooling system further includes:

a fan which impels a controlled air flow through said heat exchanger of the liquid cooling system.

18. The vacuum pump according to claim 16, wherein the controller controls a quantity of cooling liquid flowing through said heat exchanger.

19. The vacuum pump according to claim 13, wherein the cooling system includes:

a pump chamber housing cooling system which cools the pump chamber housing of the vacuum pump from the outside; and a rotor cooling system which cools the rotors disposed in the pump chamber housing from the inside.

20. The vacuum pump according to claim 19, wherein the pump chamber housing cooling system cools an exterior of a pump chamber housing of the vacuum pump with impelled air and the rotor cooling system cools the rotors disposed in the pump chamber housing with a cooling liquid and further including:

a heat exchanger, which is cooled with the impelled air from the pump chamber housing cooling system that cools the housing exterior.

21. The vacuum pump according to claim 20, wherein the pump chamber housing cooling system further cools the pump chamber housing of the vacuum pump with a liquid.

22. The vacuum pump according to claim 21, wherein the cooling liquid exiting the heat exchanger is supplied to the rotor cooling system and the pump chamber housing cooling system, the controller selectively controlling portions of the cooling liquid supplied to the rotor and pump chamber housing cooling systems.

23. The vacuum pump according to claim 22, further including:

a second heat exchanger for the cooling liquid supplied to the housing cooling system.

24. The vacuum pump according to claim 19, wherein the controller controls the pump chamber housing cooling system and the rotor cooling system such that a quantity of heat dissipated from the rotor cooling system and a quantity of heat dissipated from the housing cooling system are approximately equal.

25. The vacuum pump according to claim 13, wherein the second temperature sensor is disposed in the gear/motor housing.

* * * * *